US007717730B2

(12) United States Patent
Wu

(10) Patent No.: US 7,717,730 B2
(45) Date of Patent: May 18, 2010

(54) CAMERA MODULE CONNECTOR WITH DISASSEMBLING STRUCTURE

(75) Inventor: Chun-Kwan Wu, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/221,605

(22) Filed: Aug. 4, 2008

(65) Prior Publication Data

US 2009/0035992 A1 Feb. 5, 2009

(30) Foreign Application Priority Data

Aug. 3, 2007 (CN) ..... 2007 2 0041186 U

(51) Int. Cl.
*H01R 13/62* (2006.01)

(52) U.S. Cl. ..... 439/331; 439/73; 439/607.1; 439/607.27

(58) Field of Classification Search ..... 439/607.1, 439/607.5, 607.7, 607.24, 607.27, 609, 70–71, 439/330–331
See application file for complete search history.

(56) References Cited

U.S. PATENT DOCUMENTS

| | | | | |
|---|---|---|---|---|
| 7,112,083 | B2 * | 9/2006 | Nishio et al. | 439/331 |
| 7,128,607 | B2 * | 10/2006 | Li | 439/607.36 |
| 7,214,083 | B2 * | 5/2007 | Chen et al. | 439/330 |
| 7,288,003 | B2 * | 10/2007 | Ono et al. | 439/607.01 |
| 2006/0189183 | A1 | 8/2006 | Yang | |

* cited by examiner

*Primary Examiner*—Xuong M Chung-Trans
(74) *Attorney, Agent, or Firm*—Ming Chieh Chang; Wei Te Chung; Andrew C. Cheng

(57) ABSTRACT

A camera module connector (100) includes an insulative housing (1), a plurality of terminals (2) received therein, a shell (3) encircling the housing 1, and a lid 4 covering the housing (1), there are ears (411) located in the lid (4). When the connector (100) disassembled, carry the ears (411) will make disassembling easily.

7 Claims, 4 Drawing Sheets

CAMERA MODULE CONNECTOR WITH DISASSEMBLING STRUCTURE

BACKGROUND OF THE INVENTION

1. Field of the Invention

The present invention relates to camera module connector, and more particularly to a camera module connector with disassembling structure. The connector includes a lid with disassembling structure for taking the lid away from the connector easily.

2. Description of Related Art

Pub. No. US 2006/0189183 A1 discloses: a camera module connector includes an insulative housing, a plurality of terminals received therein, a shell encircling the housing, and a lid covering the housing.

Referring to FIG. 1 and 2 of the Pat US 2006/0189183 A1, the lid cover almost every portion of the housing, the shell, and the terminals. Because the material of the lid is metal, the lid can prevent the camera module received in the connector from electromagnetic interference. But when camera module received in the connector abatement of action needs to take away from the connector, the lid having no structure to disassemble makes the process of repairing complex and difficult.

Hence, an improved connector is required to overcome the disadvantages of the prior art.

SUMMARY OF THE INVENTION

Accordingly, the present invention is to provide a camera module connector, the connector includes a lid, a disassemble structure is located in the lid.

A camera module connector (100) includes an insulative housing (1), a plurality of terminals (2) received therein, a shell (3) encircling the housing 1, and a lid 4 covering the housing (1), there are ears (411) located in the lid (4). When the connector (100) disassembled, carry the ears (411) will make disassembling easily.

DETAILED DESCRIPTION OF THE INVENTION

Reference will now be made to the drawings to describe the present invention in detail.

Figure 1:
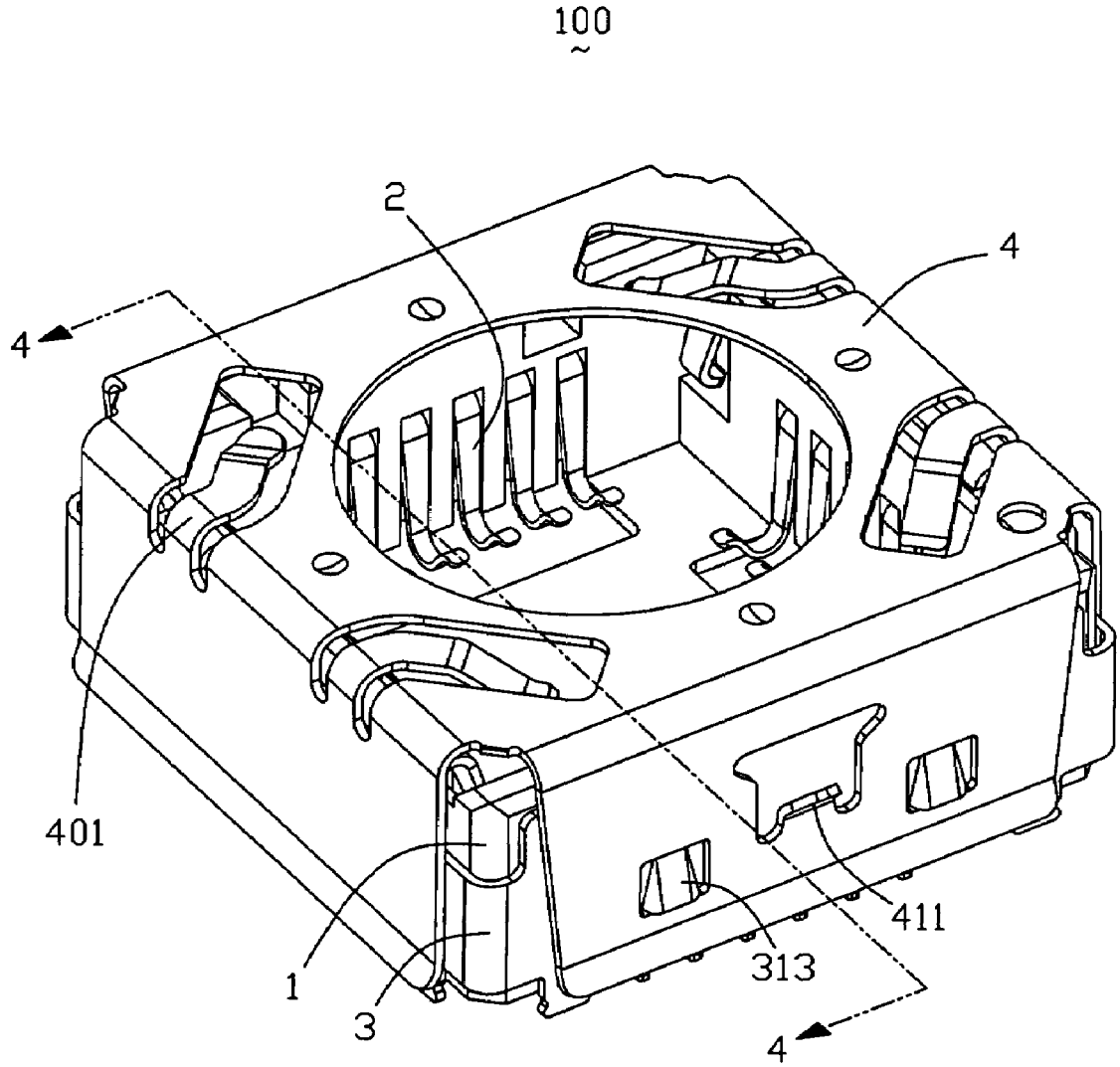
FIG. 1 is a perspective view of an electrical connector of a preferred embodiment of the present invention.
Figure 2:
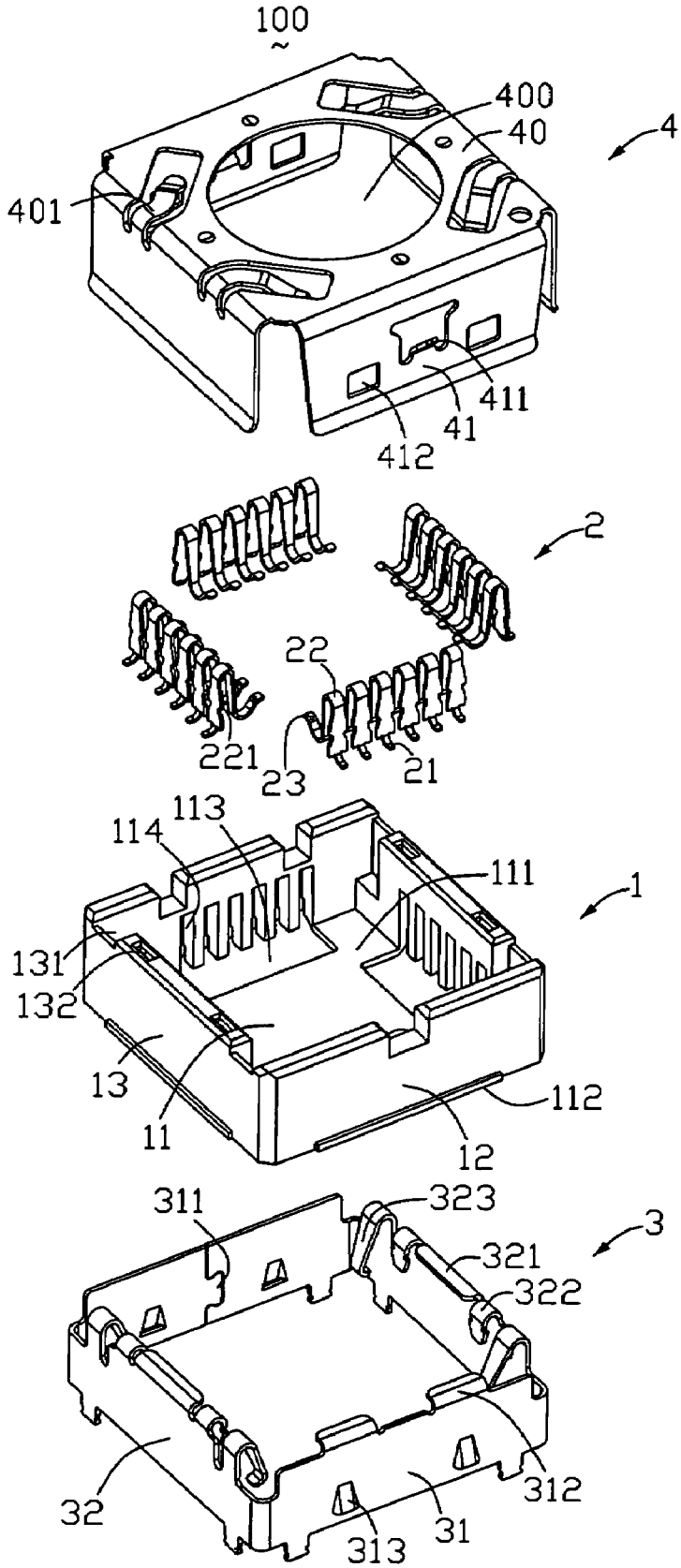
FIG. 2 is exploded view of the present invention of FIG. 1.
Figure 3:
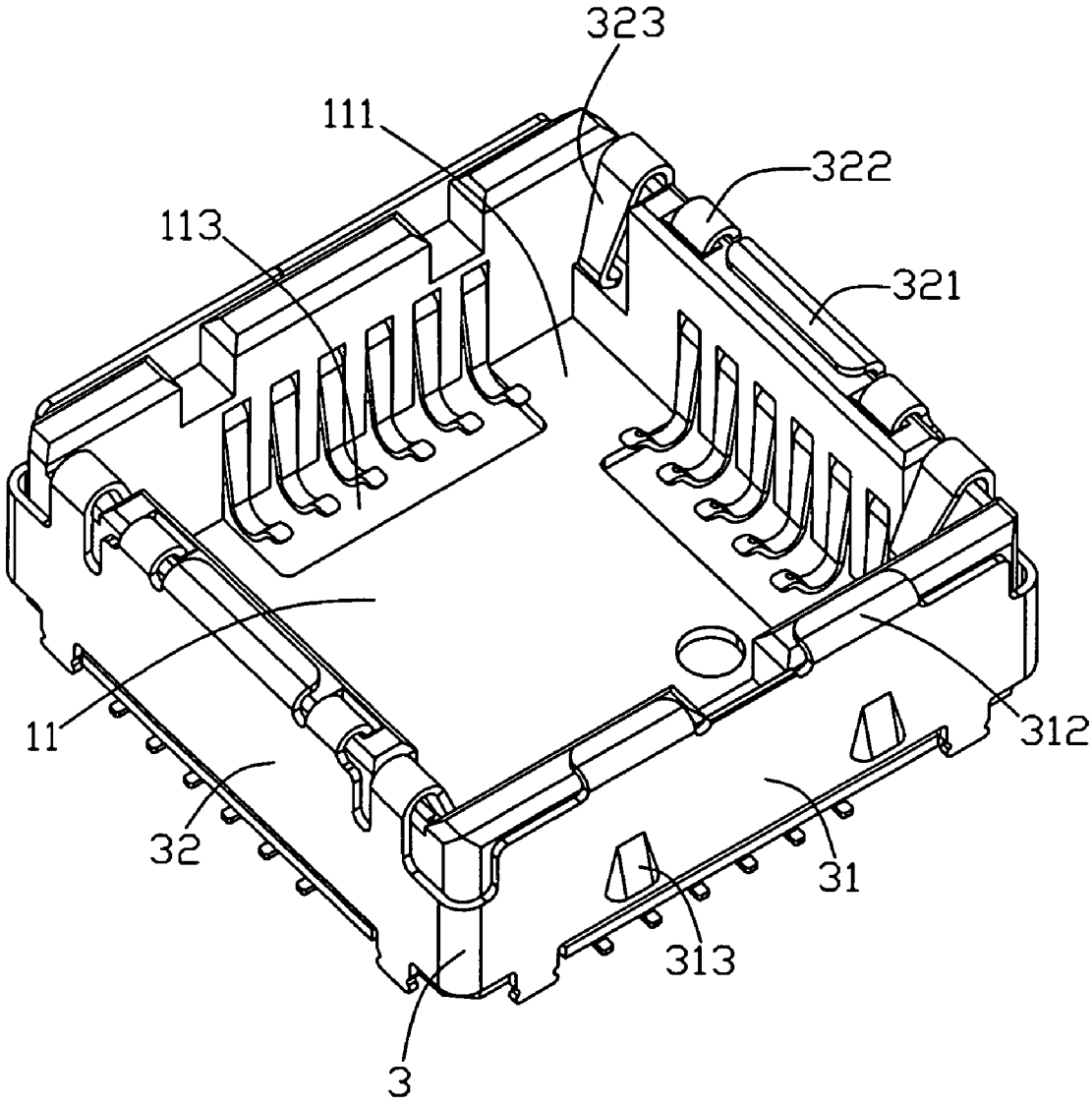
FIG. 3 is a perspective view of the electrical connector as shown in FIG. 1, a lid is disassembled.

Referring to FIG. 1 to FIG. 3, the connector 100 includes an insulative housing 1, a plurality of conductive terminals 2 disposed in the housing 1, a shell 3 encircling the housing 1 and a lid 4 covering the housing 1.

The housing 1 includes a bottom wall 11, the bottom wall 11 has a mating face 111 and a mounting face 112 opposite to the mating face 111, two pairs of side walls 12,13 extend from the four edges of the bottom wall 11, and a receiving space 10 is cooperatively defined by the bottom and four side walls 11,12,13. The four side walls 12,13 include a plurality of terminal grooves 114 disposed therein, each groove 114 respectively receives a single one of the terminals 2 therein, the bottom wall 11 has four openings 113 located near the four edge sides, and the grooves 114 extend to the openings 113. Each side wall 13 includes two slots 131 set at the corner formed by the side walls 12,13 where the side wall 12,13 meet together. A number of inserting holes 132 positioned on the upper face of the side walls 13.

The shell 3 is made of an elongate metal sheet, the two tip ends of metal sheet is combined together. The shell 3 mainly assumes to be a square frame, correspondingly to the four walls 12,13 of the housing 1, the shell 3 forms four lateral walls 31,32. A number of brims 312 extend from the top end of the lateral walls 31,32, and the brims 312 vertically bent inwardly attaching to the upper face of the side walls 12,13 of housing 100. Several anchors 322 spread from the top end of the lateral walls 32. The anchors 322 are bent downwardly and inserted into the inserting holes 132. A few of blocks 313 located on the lateral walls 31 are pressed to the final state. At least one riveting portion is located on the lateral wall 31,32. A plurality of arms 323 extend from the top end of the lateral walls 31,32 inwardly to the receiving space 10.

The lid 4 assumes to be a box without bottom, includes a roof 40 and a number of plates 41 extend from the edges of the roof 40. A through hole is located in the centre of the roof 40, a plurality of fingers 401 extend from the roof 40 inwardly to the receiving space 10. Correspondingly to the blocks 313, there are recesses 412 positioned on the plates 41. At least one ear 411 is located on the plate 41.

When the connector 100 is assembled, fix the terminals 2 in the grooves 114 through the opening 113. The contact portion 23 of the terminals 2 are in the receiving space 10, and the soldering leg 21 extend outside of the receiving space 10 from the bottom of the side walls 12,13 of the housing 1, the prickles 221 secure the terminals 2 in the housing 1. Encircle housing 1 with the shell 3, the arms 323 are positioned in the slots 131, insert the anchors 322 into the inserting holes 132, and the brims 312 attach to the top surface of the side walls 12,13. Cover housing 1 receiving the terminals 2 therein and shell 3 encircling the housing 1 with the lid 4, the blocks 313 of the shell 3 match the recesses 412 of the lid 4, the fingers 401 extend inwardly to hold the camera module received therein. When the workers disassemble the connector 100, what he need do is carrying the lid 4 with the ears 411 located on the plate 41 via instrument or his hand.

Figure 4:
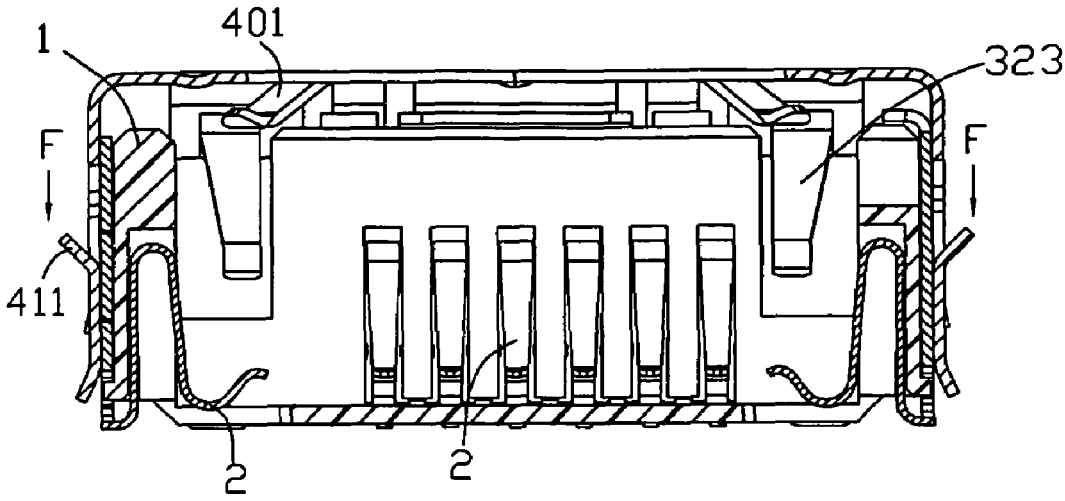
FIG. 4 is a view in cross-section on the line 4-4 in FIG. 1.
Figure 5:
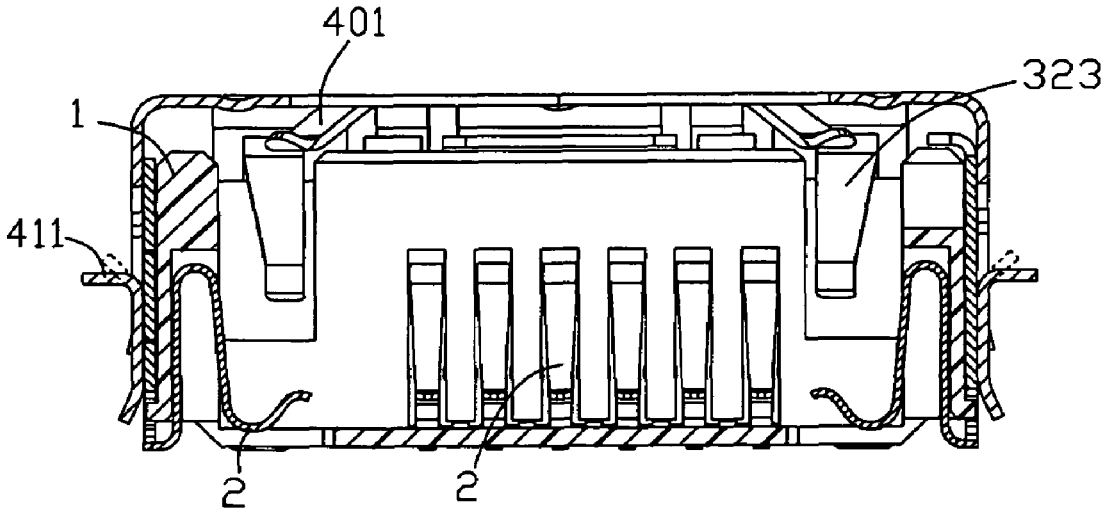
FIG. 5 is the other one view in cross-section on the line 4-4 in FIG. 1 when the ears were curved.

The state of disassembling is illustrated by the FIG. 4 and FIG. 5, the ears 411 be curve by the force F into the state of the FIG. 5, thus we can hold the ears 411 by fingers or other instrument.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A camera module connector, comprising:

an insulative housing including a bottom wall, four side walls and a receiving space cooperatively defined by the bottom and four side walls, said four side walls including a plurality of terminal grooves disposed therein;

a plurality of terminals correspondingly disposed in the terminal grooves of the insulative housing, each of said terminals including a contact end extending into said receiving space and a tail end extending outside said insulative housing;

a frame-shaped shell encircling the insulative housing; wherein said shell has a plurality of lateral walls; and a lid covering the insulative housing and encircling the shell, the lid forming a roof, a number of plates extending from the edges of the roof interengagement devices being formed on the pair of side plates and the corresponding opposite lateral walls, for engagement with each other; and a number of ears stamped with free ends upwardly and outwardly away from the plates to be pressed thereon for outwardly expanding a bottom portion of the corresponding side plate for disengagement of said interengagement devices of the side plate and of the corresponding lateral wall; wherein the shell forms a pairs of blocks, and the lid defines a pair of recesses correspondingly receiving the blocks, wherein the recesses are respectively located at opposite sides of the ear.

2. The connector claimed in claim 1, wherein said roof forms a plurality of fingers extending inwardly to the receiving space.

3. The connector claimed in claim 1, wherein the roof defines a through hole in the center thereof for the camera module leaning forward of the lid.

4. The connector claimed in claim 1, wherein said lateral walls forms a plurality of arms extending into the receiving space.

5. The connector claimed in claim 1, wherein said shell and said lid are fixed with each other.

6. An electrical connector comprising:

an insulative housing including a plurality of side walls and a bottom wall commonly defining an upwardly facing receiving cavity;

a plurality of contacts disposed in the housing with contacting sections extending into the receiving cavity;

a metallic shell including a plurality of lateral walls and attached to the housing;

a metallic lid including a top wall with at least a pair of side plates; and interengagement devices being formed on said pair of side plates and the corresponding opposite lateral walls, respectively, so as to lock the shell and the lid together after said lid is downwardly assembled to the shell; wherein each of said side plates is further equipped with an operation tab stamped with free ends upwardly and outwardly so as to be pressed for outwardly expanding a bottom portion of said corresponding side plate for disengagement of said interengagement devices of the side plate and of the corresponding lateral wall; wherein said operation tab is located essentially above the interengagement devices; wherein the interengagement devices of each of the side plates defines at least one recess located beside the operation tab; wherein the interengagement devices of each of the lateral walls forms at least a block correspondingly received in the recess of the side plate.

7. An electrical connector comprising:

an insulative housing including a plurality of side walls and a bottom wall commonly defining an upwardly facing receiving cavity;

a plurality of contacts disposed in the housing with contacting sections extending into the receiving cavity;

a metallic shell including a plurality of lateral walls and attached to the housing;

a metallic lid including a top wall with at least a pair of side plates; and complementary interengagement devices having one part formed on one of side plates, and the other part formed on at least one of the corresponding lateral wall and the corresponding side wall, for engagement with each other, so as to releasably lock the lid to at least one of said housing and said shell after said lid is downwardly assembled to said at least one of the housing and the shell; wherein each of said side plates is further equipped with an operation tab stamped with free ends upwardly and outwardly so as to be adapted to be pressed for outwardly expanding a bottom portion of the corresponding side plate for disengagement of said complementary interengagement devices from each other; wherein said operation tab is located essentially above the interengagement devices; wherein said one part is a recess and said the other part is a block received in said recess; wherein the recess is located beside the operation tab.

* * * * *